US006743040B1

(12) United States Patent
Nakamura

(10) Patent No.: US 6,743,040 B1
(45) Date of Patent: Jun. 1, 2004

(54) CONNECTOR AND A CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/680,983

(22) Filed: Oct. 8, 2003

(30) Foreign Application Priority Data

Oct. 10, 2002 (JP) ..... 2002-298084

(51) Int. Cl.[7] ..... H01R 13/627
(52) U.S. Cl. ..... 439/352
(58) Field of Search ..... 439/352, 357, 439/358, 489

(56) References Cited

U.S. PATENT DOCUMENTS 5,718,596 A 2/1998 Inaba et al.
6,561,833 B2 * 5/2003 Saka et al. ..... 439/352
6,595,793 B2 * 7/2003 Tsuji et al. ..... 439/352
6,595,795 B2 * 7/2003 Nakamura ..... 439/489
6,644,996 B2 * 11/2003 Yamashita ..... 439/352
6,655,978 B2 * 12/2003 Lutsch et al. ..... 439/352

* cited by examiner

*Primary Examiner*—Gary F. Paumen
(74) *Attorney, Agent, or Firm*—Gerald E. Hespos; Anthony J. Casella

(57) ABSTRACT

A connector has a female housing (20) with a lock arm (35) that moves onto a lock (15) Of a male housing (10). A slider (50) on the female housing (20) has pushable arms (52) that are pushed back by the male housing (10). This slider (50) is moved back and compresses springs (S). The lock arm (35) returns to engage the lock (15) when the housings (10, 20) are connected properly, and the pushable arms (52) are displaced by push canceling portions (38) to cancel the pushed state of the pushable arms (52). Thus, the springs (S) are released to move the slider (50) forward to an initial mount position. The slider (50) is pulled back to separate the housings (10, 20). Thus, an unlock pushable portion (37) of the lock arm (35) is pushed by the slider (50) to disengage the lock arm (35) from the lock (15).

10 Claims, 19 Drawing Sheets

CONNECTOR AND A CONNECTOR ASSEMBLY

BACKGROUND OF THE INVENTION

1. Field of the Invention

The invention relates to a connector and a connector assembly provided with a partial connection preventing function.

2. Description of the Related Art

U.S. Pat. No. 5,718,596 and FIG. 19(A) herein show a known connector that prevents the connector from being left partly connected during a connecting operation. Such connectors are used in an automotive airbag circuit. As shown in FIG. 19(A), the connector has mateable male and female housings 1, 2. A lock arm 3 is provided in the female housing 2 and moves onto the male housing 1. A frame-shaped slider 4 is mounted on the female housing 2 via a spring, and a resilient piece 4*a* of the slider 4 is pushed by a pushing projection 1*a* on the male housing 1. Thus, the slider 4 is moved back and resiliently compresses the spring. The connecting operation could be interrupted with the two housings 1, 2 only partly connected. However, the biasing force accumulated in the spring is released to separate the housings 1, 2 and to prevent the housings 1, 2, from being left partly connected.

The lock arm 3 deforms during connection and moves onto the male housing 1. The lock arm 3 then resiliently returns to engage a locking groove 5 when the housings 1, 2 are connected properly, as shown in FIG. 19(B). Simultaneously, the resilient piece 4*a* of the slider 4 is moved back and is deformed sufficiently to move: onto a disengaging projection 2*a* on the female housing 2. Thus, the resilient piece 4*a* of the slider 4 is disengaged from the pushing projection 1*a*, and the biasing force of the spring is released to move the slider 4 forward. At this time, a pressing portion 4*b* of the slider 4 enters a deformation space 3*a* above the lock arm 3, and prevents the lock arm 3 from being deformed.

The two housings 1, 2 may have to be separated for maintenance or other reason. Thus, the slider 4 is moved back to retract the pressing portion 4*b* from the deformation space 3*a* for the lock arm 3. The lock arm 3 is guided through a resilient deformation by opposed disengagement guiding surfaces 3*b*, 5*a* of the lock arm 3 and the locking groove 5. As a result, the lock arm 3 disengages from the locking groove 5.

This connector has a semi-locking construction for easy separation. Additionally, the connector uses the pressing portion 4*b* of the slider to avoid an unstable locked state resulting from the semi-locking construction.

The above-described connector could be used in other circuits that do not require a partial connection preventing function. For example, this connector could be used without the slider 4 and the spring to reduce costs.

The slider 4 could be detached from the female housing 2. However, the semi-locking construction permits the lock arm 3 to deform in the connected state. Thus, an insufficient holding force can make the locked state unstable.

The invention was developed in view of the above problem, and an object of the invention is to provide a connector and connector assembly that can attain a stable locked state even if a slider is detached.

SUMMARY OF THE INVENTION

The invention relates to a connector with a housing connectable with a mating housing. A lock arm is provided on the housing and engages a lock on the mating housing when the housings are connected properly. A slider is assembled with the housing for forward and backward movement along a connecting direction of the housings, and at least one biasing member is provided between the slider and housing. The biasing member is resiliently compressible and accumulates a biasing force for separating the housing from the mating housing as the slider is moved back on the housing. At least one pushable portion is provided on the slider and is displaceable along a direction intersecting the connecting direction. A pushing portion on the mating housing pushes the slider back in the process of connecting the housings, and a pushcanceling portion on the housing displaces the pushable portion to cancel a pushed state of the pushable portion as the housings are connected properly.

An unlocking portion preferably is provided on one of the slider and the lock arm and is capable of resiliently displacing the lock arm and disengaging the lock arm from the lock as the slider is moved back with respect to the housing.

The unlocking portion obviates the need for prior art semi-locking construction. Accordingly, the connector has a locking construction where the locked state of the housings is not canceled automatically by a pulling force on the housings. Therefore, the locked state is stable even if the connector is used without the slider and the biasing member.

The lock arm preferably is resiliently displaceable while moving onto the lock in the process of connecting the two housings.

The lock arm is displaced resiliently and moves onto the lock when the housings are being connected and the pushing portion pushes the pushable portion of the slider. Thus, the slider is moved back and the biasing member is compressed between the slider and the housing. The connecting operation could be interrupted at an intermediate state. However, the biasing force accumulated in the biasing member is released to separate the two housings. Thus, the two housings will not be left partly connected.

The lock arm returns resiliently to engage the lock when the housings are connected properly and the pushable portion is displaced by the push canceling portion in the direction intersecting the connecting direction. As a result, the pushed state of the pushable portion is canceled, and the biasing force in the biasing member is released to move the slider forward.

The slider is moved back to separate the properly connected housings. The lock arm then is displaced by the unlocking portion and disengages from the lock. As a result, the housings can be pulled apart.

The slider preferably is substantially plate-shaped and is mounted on one side surface of the housing. Thus, the connector can be made smaller and the slider can be mounted more easily on the housing as compared to a case where the slider is a frame-shape as in the prior art connector.

The unlock portion may prevent resilient displacement of the lock arm.

Guiding means preferably are provided on at least one of the slider and the housing to guide the slider with respect to the housing.

The slider may have at least one hook that can be pushed back by the pushing portion to move the slider back with respect to the housing in the process of connecting the two housings. The hook preferably moves onto the push canceling portion and the pushable portion is displaced up as the housings are connected properly, thereby canceling the pushed state of the hook by the pushing portion.

The biasing member preferably is compressed slightly when the slider is at an initial mount position and before the housing is connected to the mating housing to suppress shaking of the slider along the connecting direction.

The lock arm preferably is resiliently displaceable into a deformation space and the unlocking portion enters the deformation space to prevent resilient displacement of the lock arm while the slider is moved back by a specified distance from an initial mount position.

The invention also relates to a connector assembly comprising the above-described connector and a mating connector connectable therewith. The mating connector preferably is a wire-to-wire connector or a connector mounted to a piece of equipment, such as a printed circuit board.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 12A:
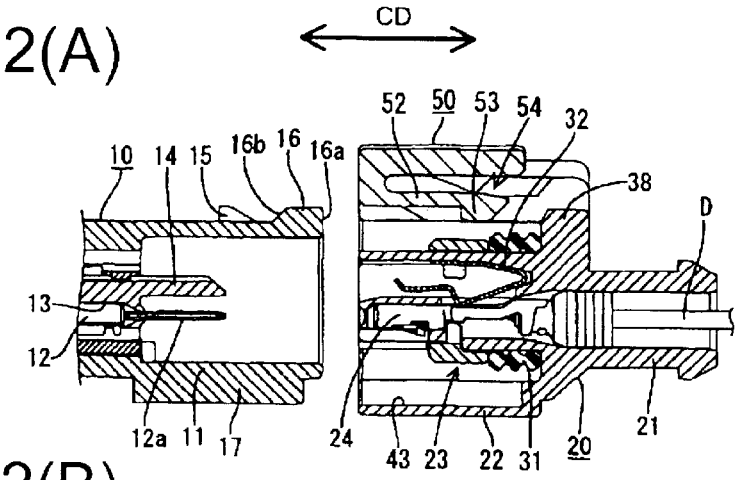
FIGS. 12(A), 12(B) and 12(C) are sections along 12A—12A, 12B—12B and 12C—12C of FIGS. 1 and 9 showing a state before the male and female housings are connected.
Figure 12B:
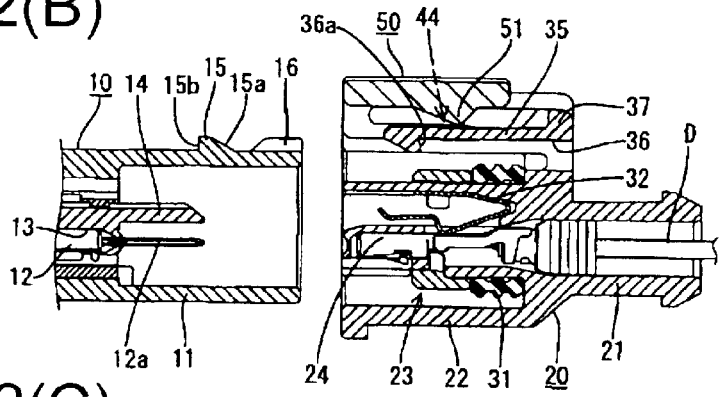
Figure 12C:
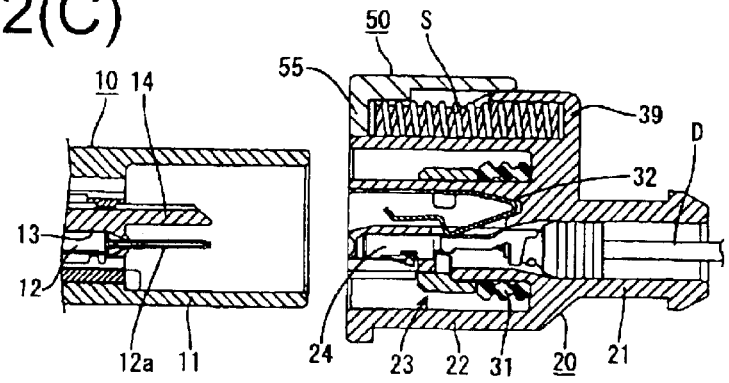
Figure 13A:
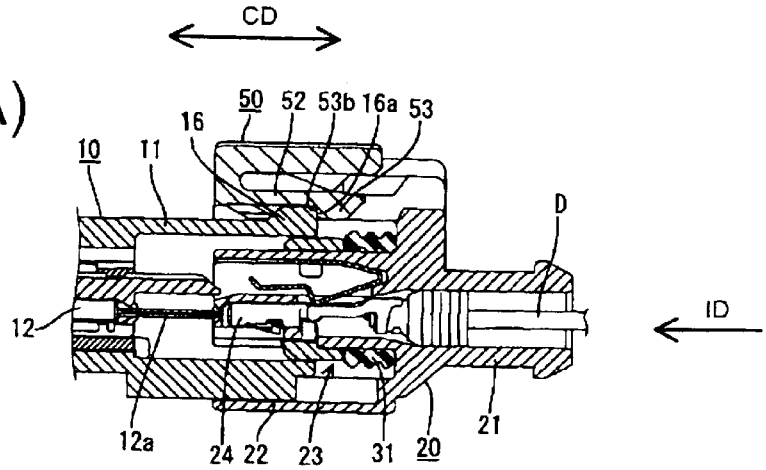
FIGS. 13(A), 13(B) and 13(C) are sections similar to FIGS. 12(A), 12(B) and 12(C) but showing the slider at an initial mount position while the two housings are being connected
Figure 13B:
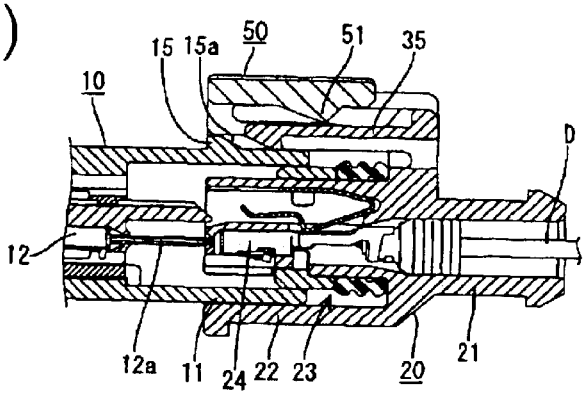
Figure 13C:
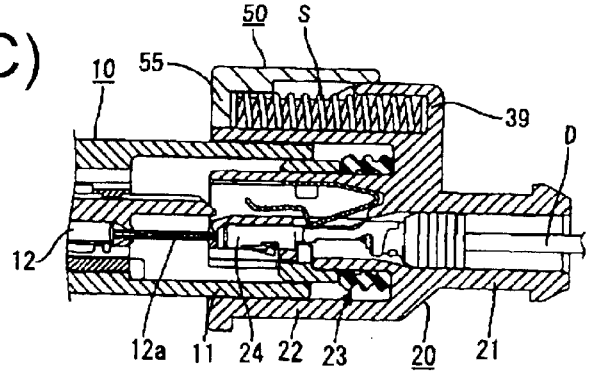

A connector according to the invention is described with reference to FIGS. 1 to 18. The connector preferably is used in an automotive airbag circuit or similar security sensitive application such as in airplanes. This connector has a male housing 10 and a female housing 20 that are connectable with each other. A slider 50 and two compression coil springs S are incorporated into the female housing 20. In the following description, engaging sides of the two housings 10, 20 are referred to as front and reference is made to FIGS. 3 and 12 concerning vertical direction VD.

Figure 1:
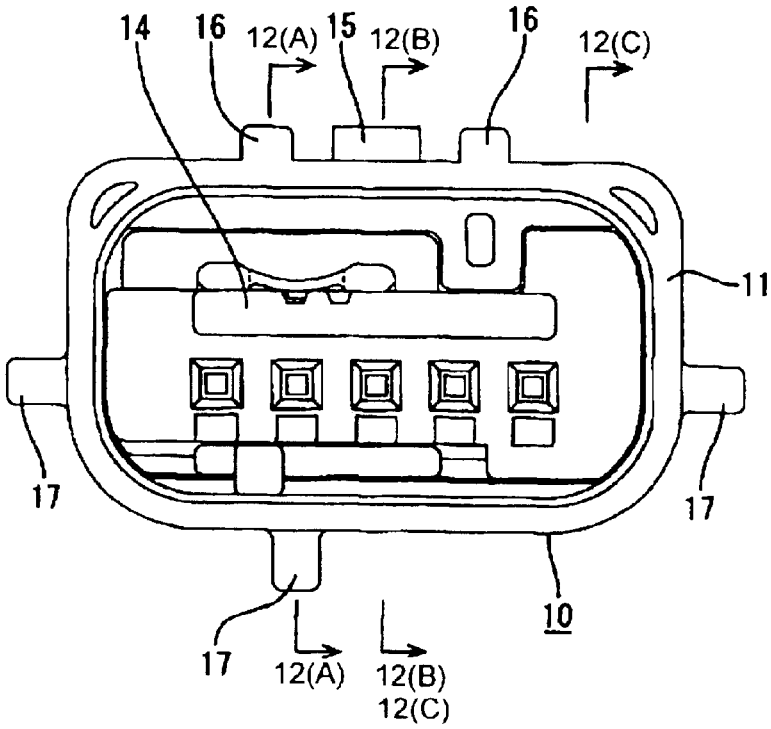
FIG. 1 is a front view of a male housing according to one embodiment of the invention.
Figure 2:
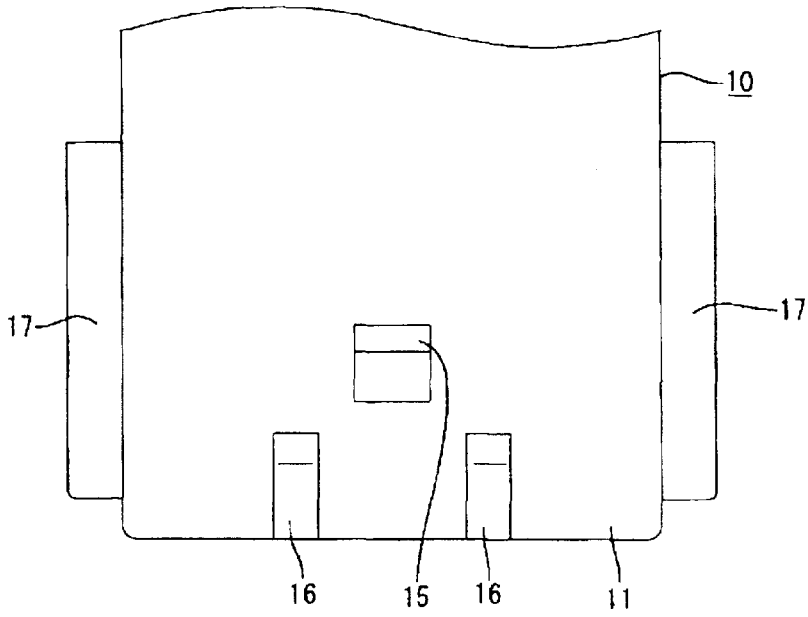
FIG. 2 is a partial plan view of the male housing.
Figure 3:
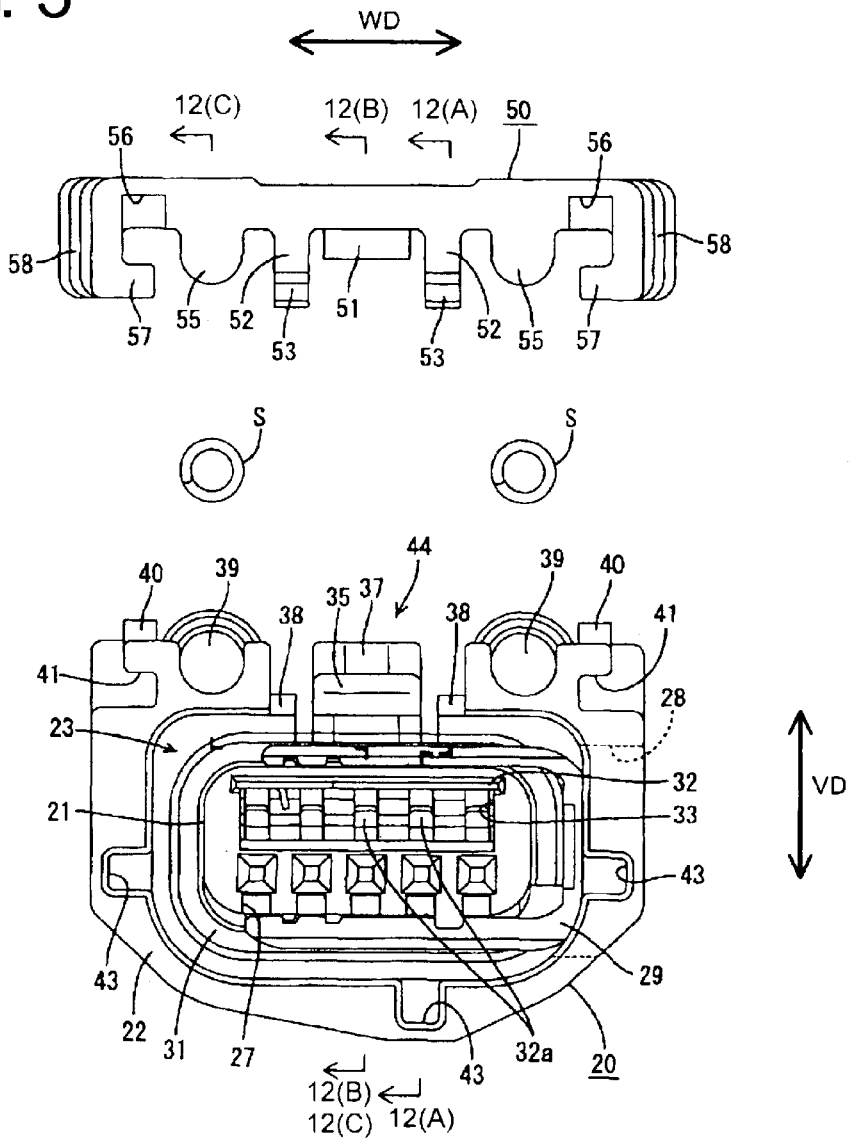
FIG. 3 is an exploded front view of a female housing, compression coil springs and a slider.
Figure 4:
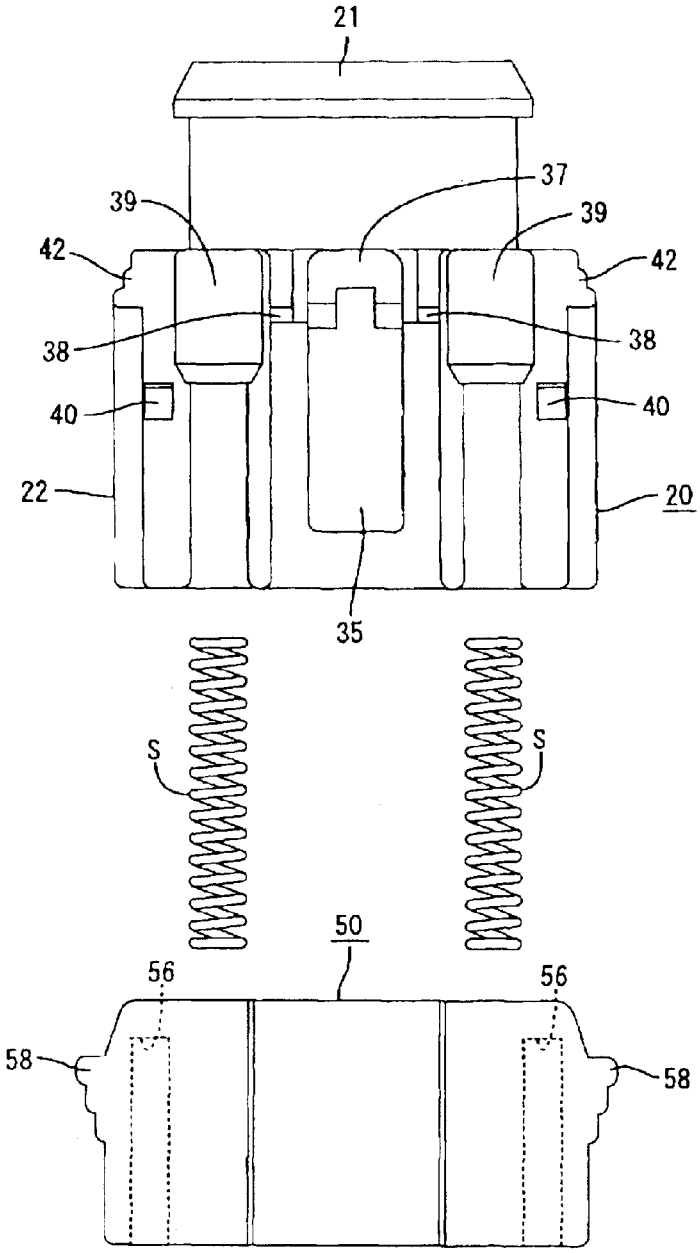
FIG. 4 is an exploded plan view of the female housing, the compression coil springs and the slider.
Figure 5:
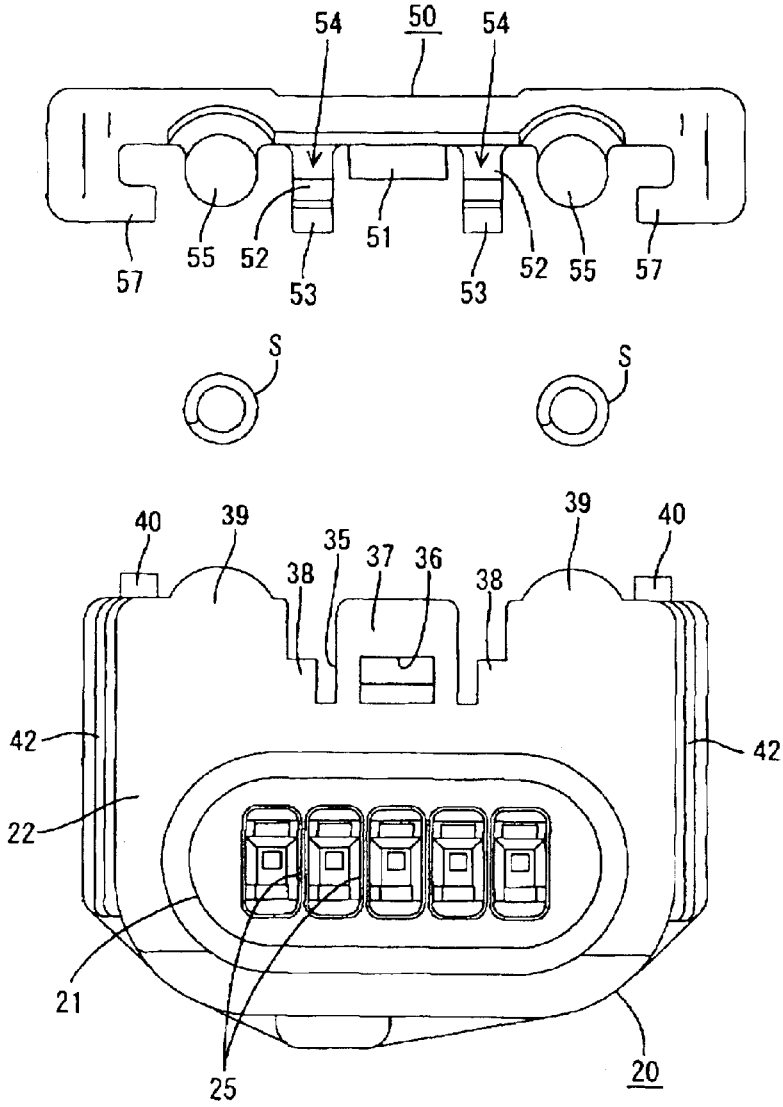
FIG. 5 is an exploded rear view of the female housing, the compression coil springs and the slider.

The male housing 10 is made e.g: of a synthetic resin, and has a forwardly projecting rectangular tubular receptacle 11. Terminal fittings 12 are arranged in a widthwise direction WD in cavities 13 in the male housing 10 and connect with ends of unillustrated wires, as shown in FIGS. 1, 2 and 12. Each male terminal fitting 12 includes a tab 12*a* that projects forwardly from the back surface of the receptacle 11. Flat plate-shaped short-terminating ribs 14 project from the back surface of the receptacle 11 above the respective tabs 12*a* and extend to substantially the same position as the front ends of the tabs 12*a*.

A lock 15 projects at a substantially widthwise middle of the upper surface of the receptacle 11 slightly spaced from the front end of the receptacle 11. A front surface 15*a* of the lock 15 is sloped up to the back, whereas a rear surface 15*b* is substantially vertical. The rear surface 15*b* of the lock 15 may be an overhanging or undercut surface. Two pushing portions 16 project at opposite sides of the lock 15 at the front end of the upper surface of the receptacle 11. A front surface 16*a* of each pushing portion 16 is substantially vertical and normal to a connecting direction CD of the housings 10, 20, whereas a rear surface 16*b* thereof is sloped down to the back. Three long narrow connection guiding ribs 17 extend substantially along the connecting direction CD on the opposite lateral surfaces and the bottom surface of the receptacle 11.

The female housing 20 is made e.g. of a synthetic resin and has a terminal accommodating portion 21 for accommodating female terminal fittings 24. A substantially rectangular outer tube 22 surrounds a front part of the terminal-accommodating portion 21, as shown in FIGS. 3 to 8. A substantially annular forwardly open connecting groove 23 is formed between the terminal-accommodating portion 21 and the outer tube 22, and is configured to receive the receptacle 11 of the male housing 10. Cavities 25 are arranged substantially in a widthwise direction WD in the terminal-accommodating portion 21 and are dimensioned to receive the female terminal fittings 24 that have been connected with ends of wires D by crimping, insulation displacement, welding, soldering or the like. The terminal fittings 24 are insertable from behind in an insertion direction ID. Each female terminal fitting 24 is accommodated in a small-diameter front half of each cavity 25, whereas a sealing member 26 fixed to a connection portion of each female terminal fitting 24 together with the wire D is fit in a large-diameter rear half of each cavity 25 to seal the cavity 25.

A forwardly open locking groove 27 is formed in the bottom wall of each cavity 25 and receives a metallic lock 24*a* of the female terminal fitting 24. The lock. 24*a* is formed by cutting and bending a portion of a main body of the female terminal fitting 24 and engages the rear surface of the locking groove 27 to lock the female terminal fitting 24 in the cavity 25. A retainer 29 is mountable into the terminal-accommodating portion 21 through a retainer mount hole 28 in the outer tube 22. The retainer 29 includes locking sections 29*a* corresponding to openings 30 in the sidewalls of the respective cavities 25 slightly behind the locking grooves 27. The retainer 29 is movable substantially along the widthwise direction WD between a partial locking position and a full locking position. The locking section s 29*a* are in the respective openings 30 and retracted from the corresponding cavities 25 when the retainer 29 is in the partial locking position. Thus, the female terminal fittings 24 can be inserted into and withdrawn from the cavities 25. However, the respective locking sections 29*a* enter the corresponding cavities 25 to engage jaws 24*b* of the main bodies of the female terminal fittings 24 when the retainer 29 is in the full locking position. A seal ring 31 is mounted behind the retainer 29 on the outer peripheral surface of the terminal-accommodating portion 21. The seal ring 31 is squeezed between the receptacle 11 and the terminal-accommodating portion 21 to provide sealing between the housings 10, 20

A forwardly open shorting-terminal accommodating chamber 33 is formed in the front of the terminal accommodating portion 21 above the cavities 25 and accommodates a conductive shorting terminal 32 for shorting the respective female terminal fittings 24. The shorting terminal 32 has a wide plate-shaped main body that can be pressed into the upper end of the shorting-terminal accommodating chamber 33. Communication holes 34 provide communication between the shorting-terminal accommodating chamber 33 and the vertically adjacent cavities 25. Resilient contact pieces 32a project back from the main body of the shorting terminal 32 for resilient contact with the female terminal fittings 24 in the respective cavities 25. The resilient contact pieces 32*a* have forwardly-cantilevered free ends that are resiliently deformable up and down in a direction intersecting the connecting direction CD.

Figure 7:
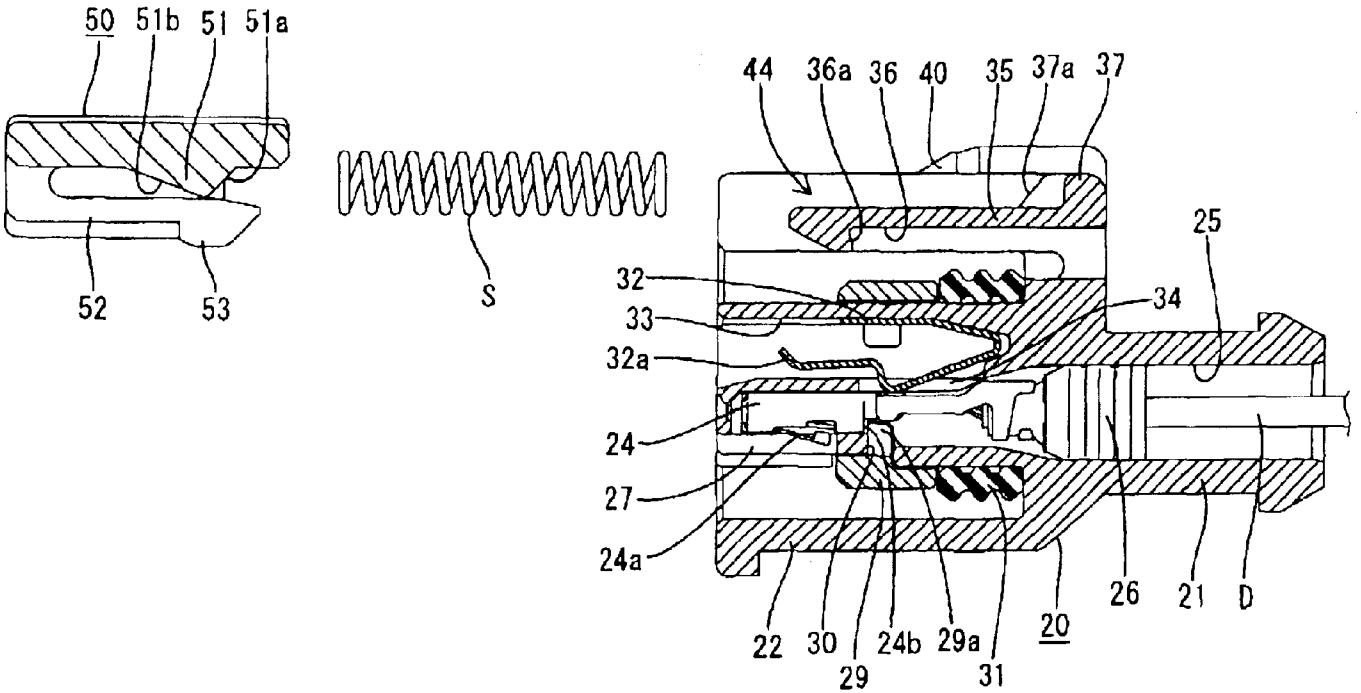
FIG. 7 is a section along 7—7 of FIG. 3.

Slits are formed in the upper part of the outer tube 22 to form a lock arm 35 substantially in the widthwise middle of the outer tube 22. The lock arm 35 is cantilevered forwardly, and the free front end is resiliently deformable up and down in a direction intersecting the connecting direction CD. A groove 36 is formed in the lower surface of the lock arm 35 and is dimensioned to receive the lock 15 of the male housing 10. The groove 36 has an open rear end, as shown in FIG. 7, and a closed front end defined by a front surface 36*a*. The front surface 36*a* of the groove 36 is aligned to conform to the inclination of the rear surface 15*b* of the lock 15, and is engageable with the lock 15. An unlock pushable portion 37 projects out from the upper surface of the rear end of the lock arm 35 and has substantially the same width as the lock arm 35. Opposite sides of the unlock pushable portion 37 substantially correspond to the supported portion of the lock arm 35 and project forward a short distance on the lock arm 35. Front surfaces 37*a* of these opposite sides slant up to the back.

Two push canceling portions 38 are provided on the upper part of the outer tube 22 at opposite sides of the lock arm 35. The push canceling portions 38 are about half the height of the lock arm 35, and front surfaces 38*a* of the push canceling portions 38 slant up and to the back. Two spring receiving portions 39 are on the upper part of the outer tube 22 at outer sides of the push canceling portions 38, and the compression coil springs S can be accommodated from the front in the spring receiving portions 39. Each spring receiving portion 39 is a bottom ed hole with an open front end and an upper wall that is cut off up to a specified depth. The inner surface of each spring receiving portion 39 has an arcuate shape that substantially fits the compression coil spring S and the rear wall of each spring receiving portion 39 can receive the rear end of the corresponding compression coil spring S.

Two front-stops 40 project from the upper part of the outer tube 22 at the outer sides of the spring receiving portions 39. The front surfaces of the front-stops 40 slope up and to the back, whereas the rear surfaces thereof are substantially vertical and normal to the connecting direction CD. Two guiding grooves 41 are formed on the lower side of the outer tube 22 substantially opposite from the front-stops 40. Two female-housing operating portions 42 are provided at opposite sides of the rear end of the outer tube 22. The female-housing operating portions 42 are stepped so that the width of the female housing 20 is reduced stepwise toward the rear end. Thus, the female housing 20 easily can be pushed forward from behind. Connection guiding grooves 43 are provided in the inner surface of the outer tube 22 for receiving the respective connection guiding ribs 17 of the male housing 10.

A wide plate-shaped slider 50 made e.g. of a synthetic resin is mountable on the upper surface of the outer tube 22. The slider 50 is mounted on the female housing 20 for relative movement substantially along a connecting direction CD between an initial mount position (see FIGS. 12) and retreated position (FIG. 16). The slider 50 in the initial mount position (FIG. 12) is at its foremost position with respect to the female housing 20 so that the front end of the slider 50 aligns with the front end of the female housing 20. The slider 50 in the retreated position. (see FIGS. 16) is at its rearmost position with respect to the female housing 20 so that the rear end of the slider 50 substantially aligns with the rear end of the outer tube 22. The slider 50 has a length that preferably is about half the length of the female housing 20, and a width larger than the width of the female housing 20. The slider 50 may move along a direction slightly inclined with respect to the connecting direction CD of the housings 20, 10 (e.g. at an angle less than about 10°). However, the movement component of the slider 50 along the connecting direction CD is sufficient to build up a biasing force in the biasing member S that will separate the housings 20, 10 if the connection process is interrupted before reaching a proper connection of the housings 20, 10. The inclined movement of the slider 50 along the connecting direction CD is encompassed by the description of the slider 50 moving substantially along the connecting direction CD.

An unlock pushing portion 51 projects down at a substantially widthwise middle of the bottom surface of the slider 50. A rear surface 51*a* of the unlock pushing portion 51 slopes up and back, and has substantially the same inclination as the front surface 37*a* of the unlock pushable portion 37. A front surface 51*b* of the unlock pushing portion 51 slopes up and to the front, and has an inclination more moderate than the rear surface 51*a*. The unlock pushing portion 51 projects by a distance to reach close to the upper surface of the lock arm 35 with the slider 50 mounted on the female housing 20. Additionally, the unlock pushing portion 51 overlaps the unlock pushable portion 37 along a vertical direction VD and faces the unlock pushable portion 37 along the connecting direction CD (see FIG. 12(B)). The unlock pushing portion 51 enters a deformation space 44 for the lock arm 35 to prevent the resilient displacement of the lock arm 35 while the slider 50 is moved back to a position shown in FIGS. 14 from the initial mount position of FIGS. 12. A moving area of the slider 50 defines a prevention area where unlocking is prevented. On the other hand, the unlock pushing portion 51 is retracted from the deformation space 44 for the lock arm 35 when the slider 50 is moved back from the prevention area. Thus, resilient deformation of the lock arm 35 is permitted (see FIG. 15(B)). In other words, a moving area of the slider 50 from the rear end (see FIGS. 14) of the prevention area to the retreated position (see FIGS. 16) defines a permission area where unlocking is permitted. The unlock pushing portion 51 can push the unlock pushable portion 37 when the slider 50 reaches the retreated position. Thus, the lock arm 35 can undergo an upward displacement (see FIG. 16(B)). The moving area of the slider 50 consists of the prevention area at the front side and the permission area at the backside.

Two pushable arms 52 project from the bottom surface of the slider 50 at the opposite sides of the unlock pushing portion 51. Each pushable arm 52 is cantilevered rearwardly from the front end of the slider 50. A hook 53 projects down at the extending end of the pushable arm 52. A rear surface 53*a* of the hook 53 slopes up and to the back, whereas a front surface 53*b* is substantially vertical. The pushable arms 52 can be displaced resiliently up and down toward and away from a main body of the slider 50 with the front ends thereof as supporting points. Deformation spaces 54 are defined between the pushable arms 52 and the main body of the slider 50. The pushable arms 52 are covered by the main body of the slider 50, and thus are protected without being exposed to the outside. The pushable arms 52 are at opposite sides of the lock arm 35 in the mounted state of the slider 50. The deformation spaces 54 for the pushable arms 52 and the deformation space 44 for the lock arm 35 overlap along the vertical direction VD (see FIG. 9). Additionally, the hooks 53 overlap the push canceling portions 38 and the pushing portions 16 of the male housing 10 along the height direction (see FIG. 12(A)). Accordingly, the pushing portions 16 can push the hooks 53 back along the connecting direction CD in the process of connecting the housings 10, 20. Accordingly, the slider 50 is moved back with respect to the female housing 20 (see FIGS. 13 and 14). The hooks 53 move onto the push canceling portions 38 as the housings 10, 20 are connected and the pushable arms 52 are displaced up to cancel the pushed state of the hooks 53 by the pushing portions 16 (see FIGS. 16).

Two spring pressing portions 55 are provided at the outer sides of both pushable arms 52 of the slider 50 for holding the compression coil springs S at their front-limit positions. Each spring pressing portion 55 has a substantially L-shape cross section with a front wall that presses the front end of the corresponding compression coil spring S and a wall that extends forward and back along the connecting direction CD. The compression coil springs S are compressed resiliently between the spring pressing portions 55 and the spring receiving portions 39 to accumulate biasing forces to separate the housings 10, 20 as the slider 50 is moved from the initial mount position toward the retreated position (see FIG. 15(C)). Further, arcuate inner peripheral surfaces of the walls of the spring receiving portions 39 extend forward and back and conform to the shape of the compression coil springs S.

Front-stop grooves 56 are formed in the bottom surface of the slider 50 outwardly of the spring pressing portions 55 and receive the front-stops 40 of the female housing 20. The front-stop grooves 56 open forward and down and have a depth to reach a position close to the rear end of the slider 50. The rear surfaces of the front-stop grooves 56 are substantially vertical and contact the rear surfaces of the front-stops 40 of the female housing 20 (see FIG. 10) to prevent the slider 50 from moving forward from the initial mount position.

Two guides 57 project down toward the female housing 20 from the opposite sides of the slider 50 and then project inward. Accordingly, the guides 57 have C-shapes when seen in section (see FIG. 3). The guides 57 fit in the guiding grooves 41 of the female housing 20 in the mounted state of the slider 50 to guide relative movements of the slider 50 with respect to the female housing 20 (see FIG. 9). Two slider operating portions 58 are provided at the opposite side surfaces of the rear end of the slider 50. The slider operating portions 58 are stepped to bulge out sideways to a larger degree toward the back. Thus, the slider 50 can be pulled back from the front (see FIG. 10).

Figure 6:
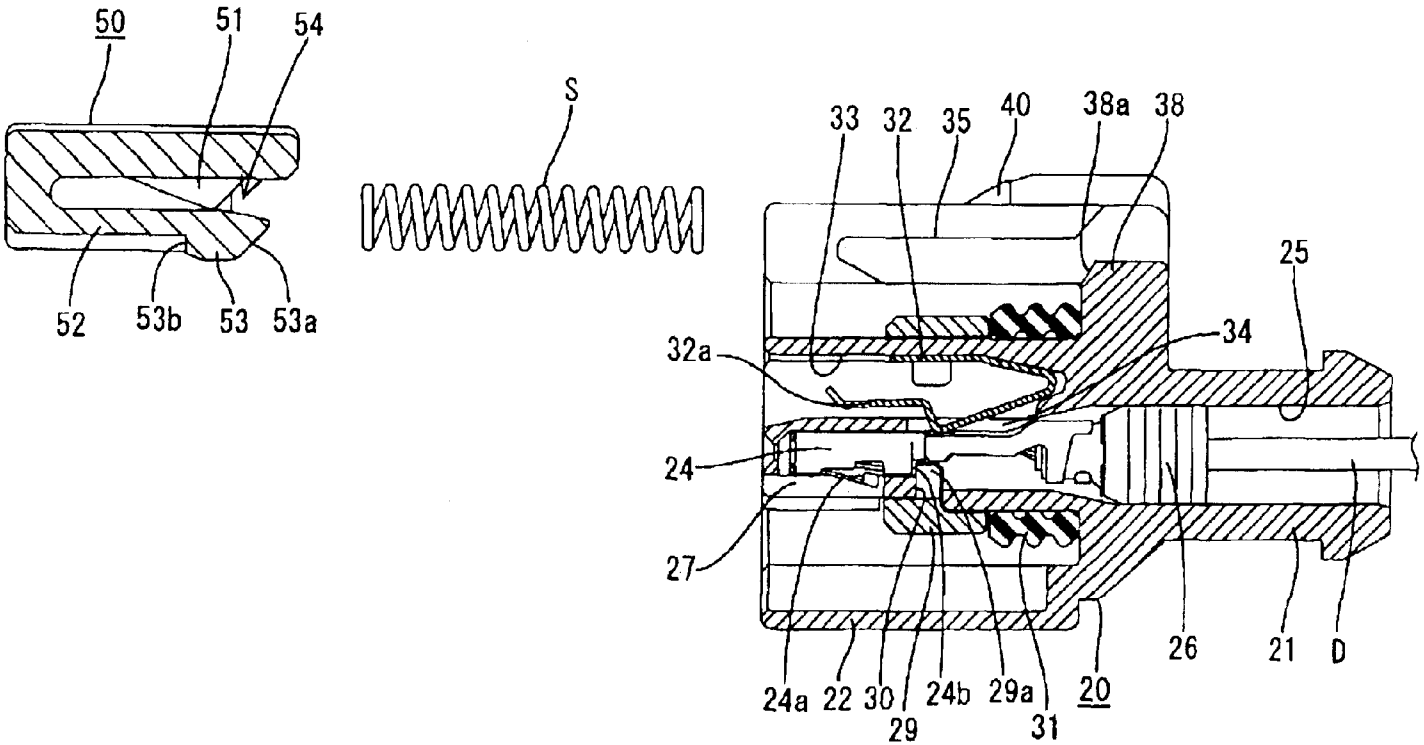
FIG. 6 is a section along 6—6 of FIG. 3.
Figure 8:
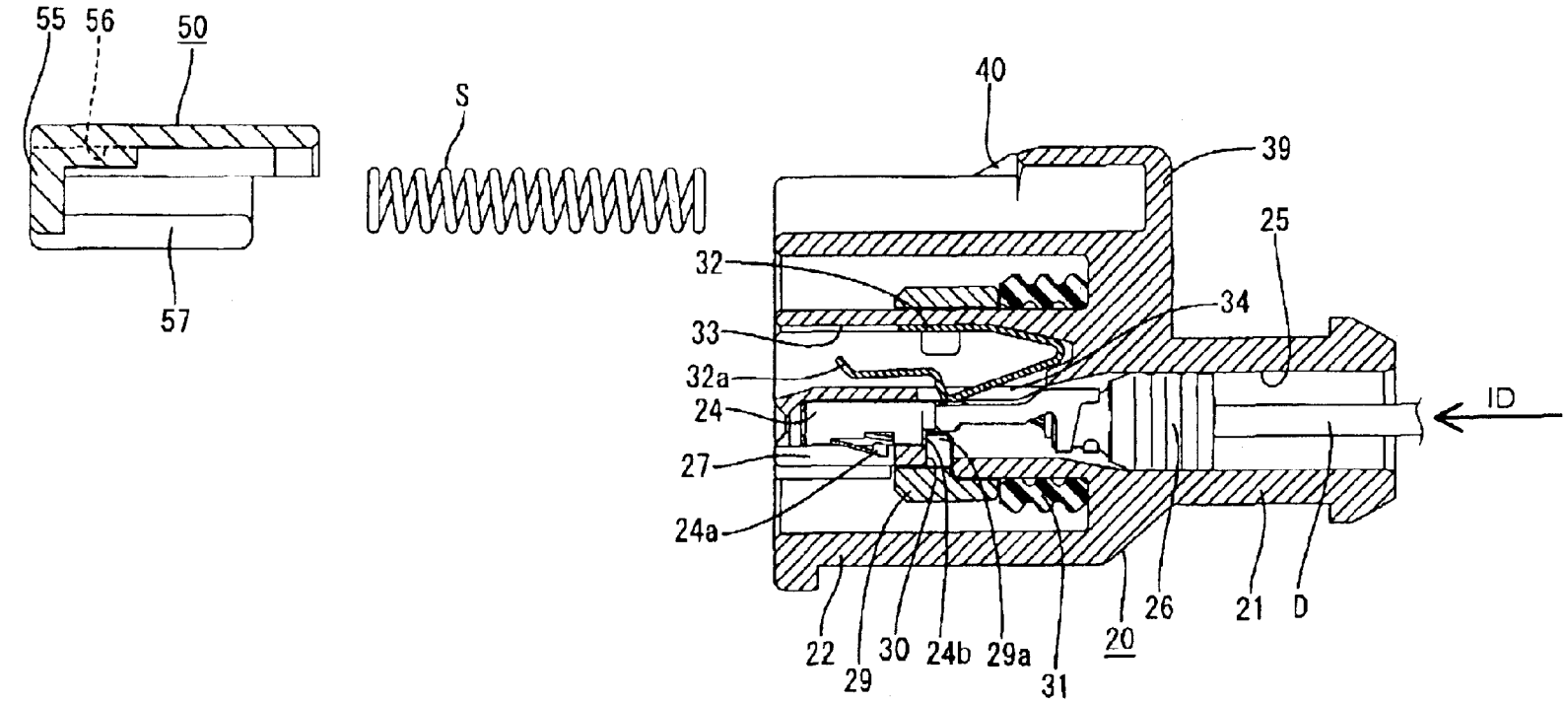
FIG. 8 is a section along 8—8 of FIG. 3.
Figure 9:
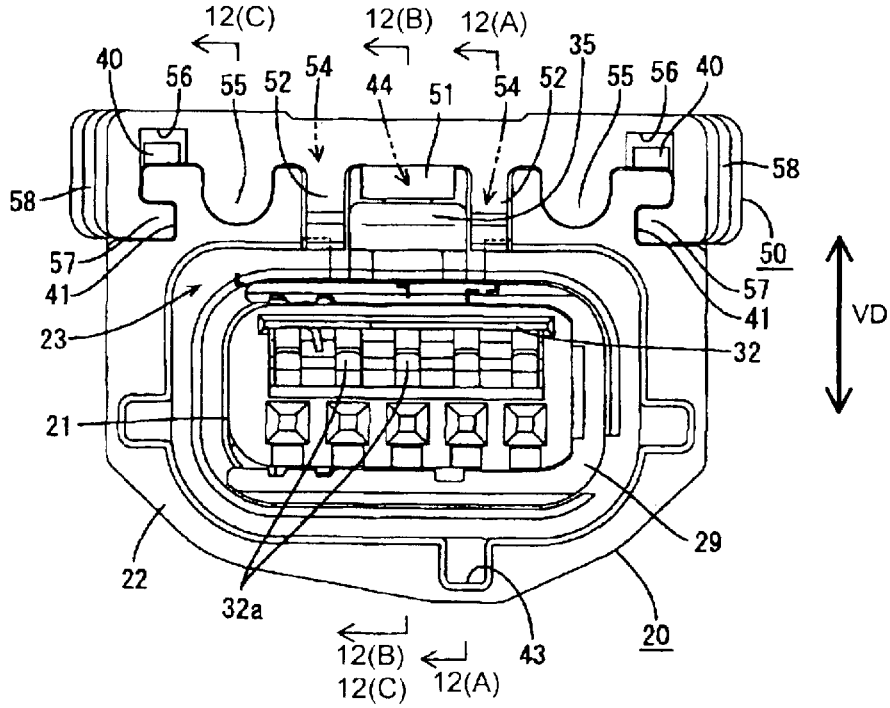
FIG. 9 is a front view showing a state where the slider is mounted on the female housing.
Figure 10:
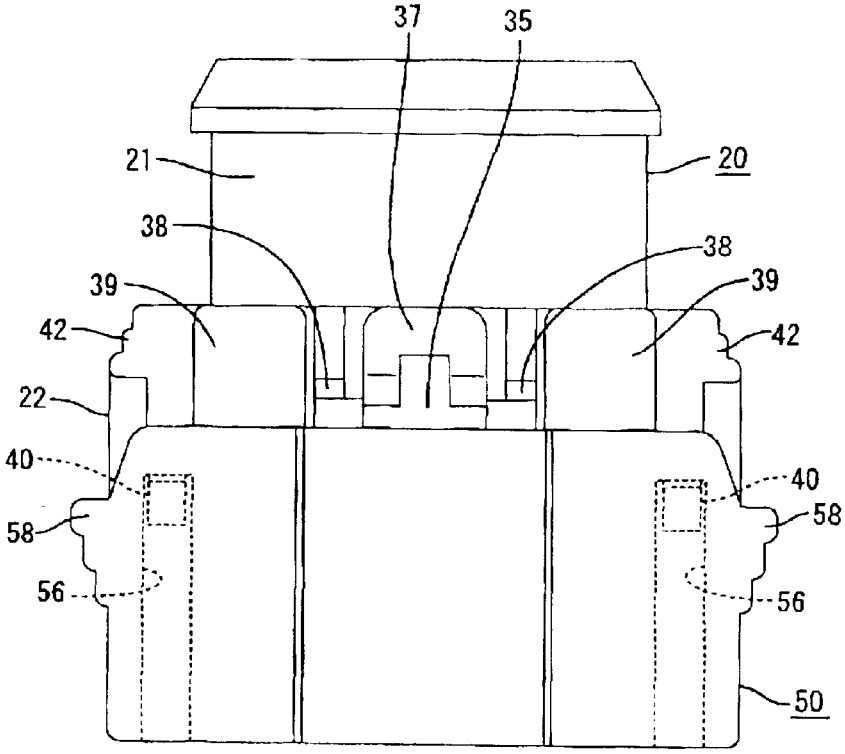
FIG. 10 is a plan view showing the slider on the female housing.
Figure 11:
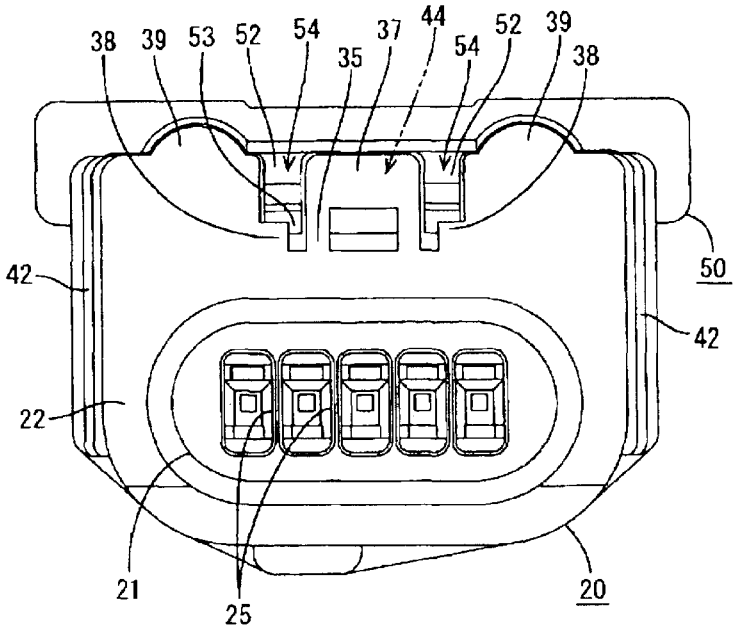
FIG. 11 is a rear view showing the slider on the female housing.

The female connector 20 is assembled by inserting the compression coil springs S into the corresponding spring receiving portions 39 of the female housing 20 from the front, as shown in FIGS. 6 to 8. The slider 50 then is mounted on the upper side of the outer tube 22 from the front to attain the state shown in FIGS. 9 to 12. In the process of mounting the slider 50, the rear walls of the front-stop grooves 56 temporarily move onto the front-stops 40, and then move over the front-stops 40 when the slider 50 reaches the initial mount position. Thus, the rear surfaces of the front-stops 40 contact the back surfaces of the front-stop grooves 56 so that the slider 50 will not move forward from the initial mount position (see FIG. 10). The compression coil springs S are compressed slightly at the initial mount position (see FIG. 12(C)), and hence suppress shaking of the slider 50 along the connecting direction CD. Additionally, the unlock pushing portion 51 enters the deformation space 44 above the lock arm 35 to prevent displacement of the lock arm 35 (see FIG. 12(B)). Assembly proceeds by mounting the seal ring 31 on the terminal-accommodating portion 21. The retainer 29 then is mounted at the partial locking position and the shorting terminal 32 is accommodated into the shorting-terminal accommodating chamber 33. The female terminal fittings 24 are crimped or otherwise connected with the wires D and are inserted into the cavities 25. The retainer 29 then is moved to the full locking position to lock the female terminal fittings 24 in cooperation with the metallic locks 24*a*. Of course, the respective parts may be assembled in an order and by a method other than the order and method described above.

The slider 50 is substantially plate-shaped and is mounted on one side surface of the female housing 20. Thus, the connector is small and the slider 50 is mounted easily on the female housing 20, as compared to a case where the slider 50 is a frame-shaped, as in the prior art connector.

Figure 14A:
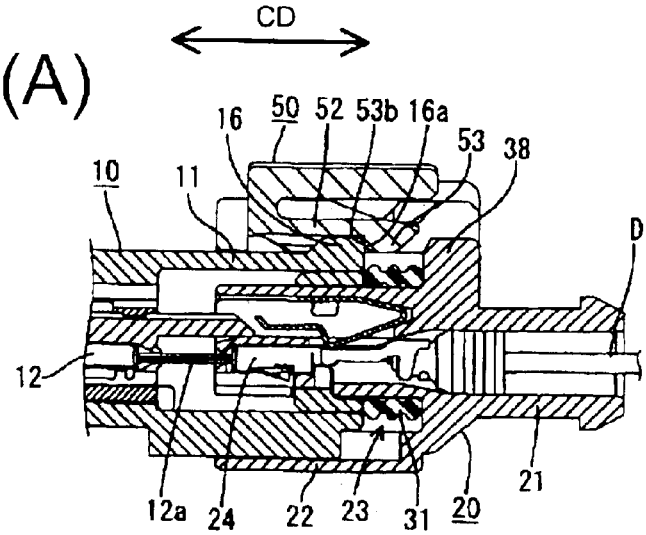
FIGS. 14(A), 14(B) and 14(C) are sections similar to FIGS. 12(A), 12(B) and 12(C) but showing the slider near a boundary between a prevention area and a permission area while the housings are being connected.
Figure 14B:
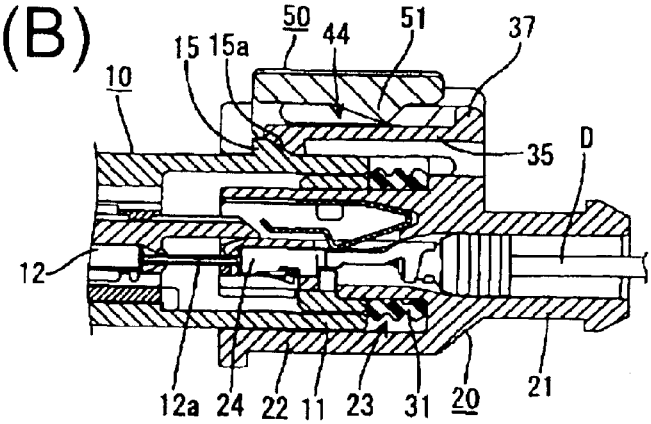
Figure 14C:
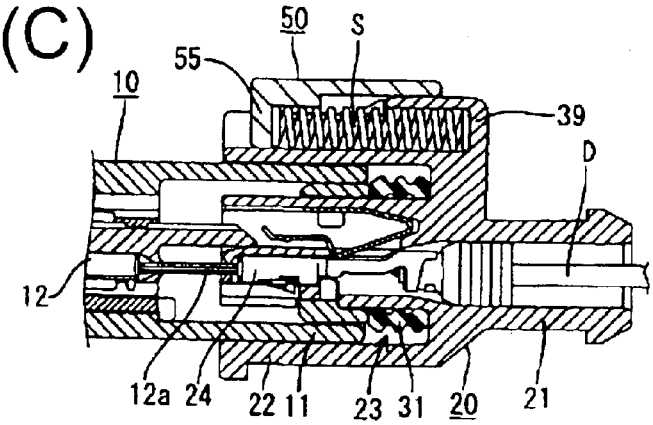
Figure 15A:
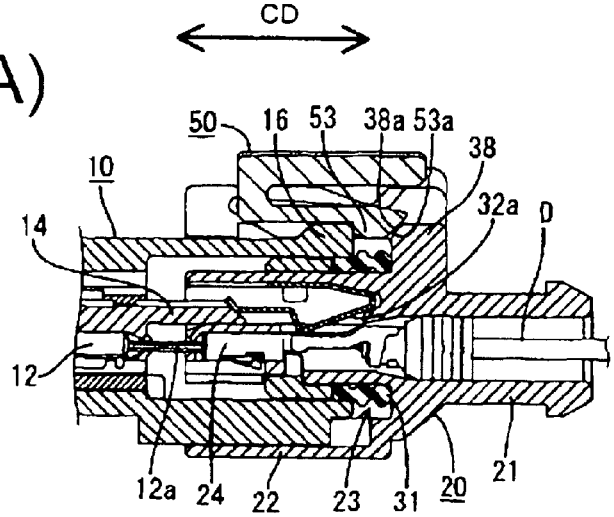
FIGS. 15(A), 15(B) and 15(C) are sections similar to FIGS. 12(A), 12(B) and 12(C) but showing the slider in the permission area while the two housings are being connected.
Figure 15B:
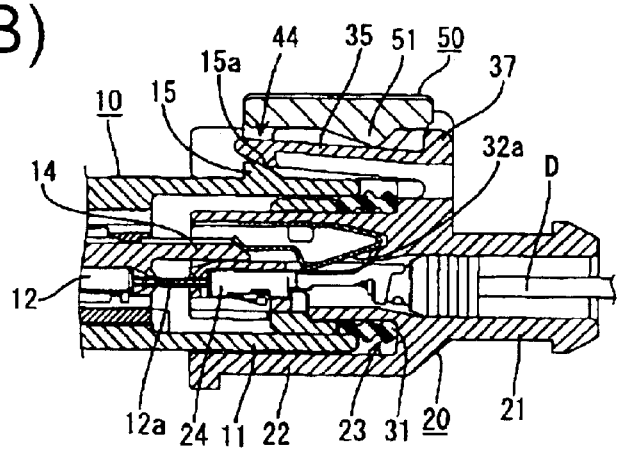
Figure 15C:
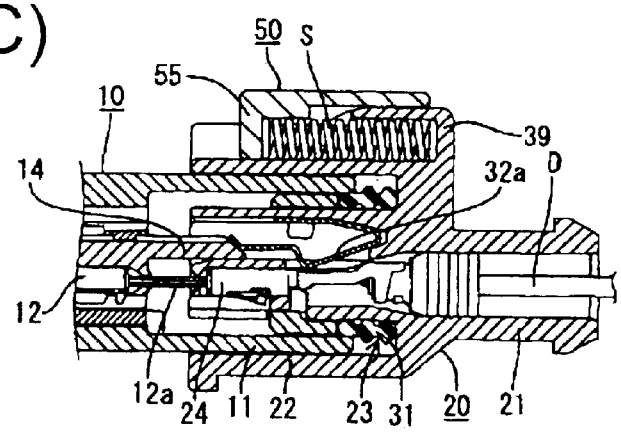

The two housings 10, 20 are connected by aligning the receptacle 11 with the connecting groove 23 along the connecting direction CD and pushing the female-housing operating portions 42 forward. The front surfaces 16*a* of the pushing portions 16 contact the front surfaces 53*b* of the hooks 53 of the pushable arms 52 (see FIG. 13(A)) when the receptacle 11 enters the connecting groove 23 to a specified depth. As a result, the pushing portions 16 push the pushable arms 52 back and move the slider 50 back from the initial mount position, as shown in FIGS. 14. The spring pressing portions 55 support the front ends of the compression coil springs S, while the spring receiving portions 39 support the rear ends of the compression coil springs S. Thus, the relative backward movement of the spring pressing portions 55 compress the compression coil springs S so that the springs S accumulate biasing forces for separating the two housings 10, 20 (see FIG. 14(C)).

The connecting operation could be interrupted while the two housings 10, 20 are connected only partly. In this situation, the biasing forces accumulated thus far in the resiliently compressed coil springs S are released. As a result, the hooks 53 of the pushable arms 52 of the slider 50 push the pushing portions 16 back to separate the housings 10, 20. Thus, the two housings 10, 20 are prevented from being left partly connected.

The unlock pushing portion 51 retracts from the deformation space 44 for the lock arm 35 as the slider 50 is moved back from the prevention area (FIGS. 14) to the permission area. Thus, the lock arm 35 moves onto the front surface 15*a* of the lock 15 and resiliently displaces in a direction intersecting the connecting direction CD (see FIG. 15(B)). At this time, the rear surfaces 53*a* of the hooks 53 contact the front. surfaces 38*a* of the push canceling portions 38 (see FIG. 15(A)). In this process, the tabs 12*a* of the male terminal fittings 12 contact the female terminal fittings 24, the short-terminating ribs 14 contact the resilient contact pieces 32*a*, and the front end of the receptacle 11 contacts the seal ring 31. The hooks 53 move onto the push canceling portions 38 as the connection progresses and the pushable arms 52 are displaced up. Areas of engagement of the front surfaces 16*a* of the pushing portions 16 with the front surfaces 53*b* of the hooks 53 gradually decrease as the pushable arms displace up.

Figure 16A:
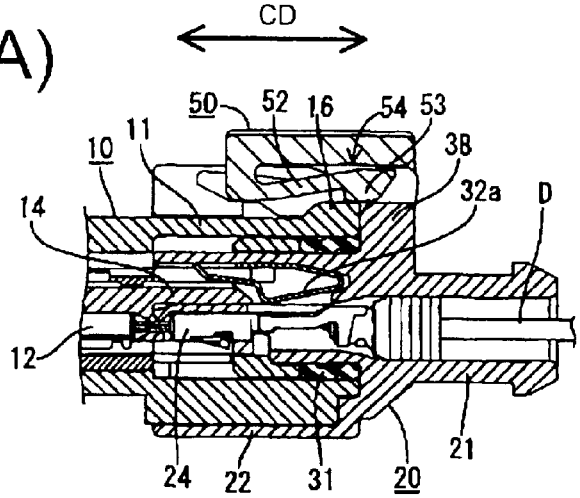
FIGS. 16(A), 16(B) and 16(C) are sections similar to FIGS. 12(A), 12(B) and 12(C) but showing the slider at a retreated position when the two housings are connected properly.

The slider 50 is pushed to the retreated position as the housings 10, 20 become properly connected and the pushing portions 16 no longer push the hooks 53 (see FIG. 16(A)). At. this time, the lock arm 35 has moved over the lock 15 (see FIG. 16(B)). However, the unlock pushing portion 51 pushes the unlock pushable portion 37 and holds the lock arm 35 in a resiliently displaced condition. The compression coil springs S are released when the pushed state by the pushing portions 16 is cancelled and the slider 50 starts moving forward. As a result, the unlock pushing portion 51 no longer pushes the unlock pushable portion 37 and the lock arm 35 is restored resiliently. The lock 15 enters the groove 36 as the lock arm 35 is restored and the front surface 36*a* of the groove 36 engages the rear surface 15*b* of the lock 15 to hold the housings 10, 20 together. The hooks 53 move over the pushing portions 16 when the slider 50 moves forward to the initial mount position. Thus, the pushable arms 52 are restored resiliently (see FIG. 17(A)) and the rear surfaces 53*a* of the hooks 53. contact the rear surfaces 16*b* of the pushing portions 16. Additionally, the unlock pushing portion 51 enters the deformation space 44 and prevents displacement of the lock arm 35 (see FIG. 17(B)). Accordingly, the connector has a double-locking construction.

The male and female terminal fittings 12, 24 are connected properly when the housings 10, 20 reach the properly connected state. Additionally, the short-terminating ribs 14 deform the resilient contact pieces 32*a* of the shorting terminal 32 away from the corresponding female terminal fittings 24. As a result, the shorted state of the female terminal fittings 24 is canceled. Further, the seal ring 31 is squeezed between the receptacle 11 and the terminal accommodating portion 21 to provide sealing between the housings 10, 20.

Figure 16B:
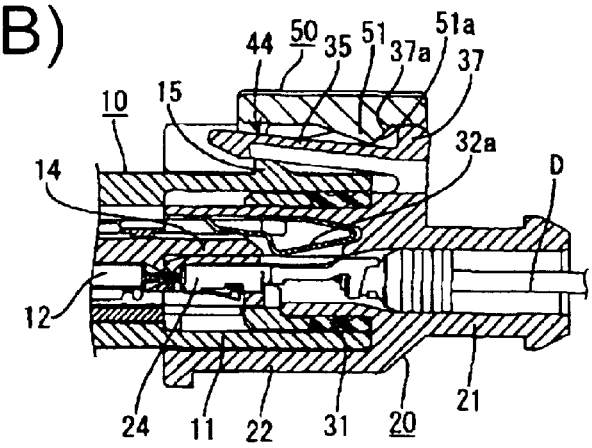
Figure 16C:
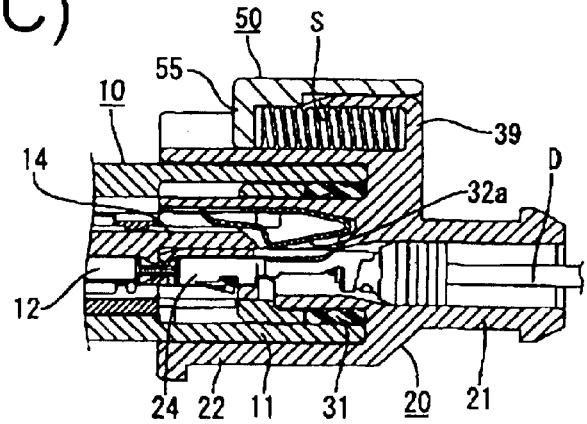
Figure 17A:
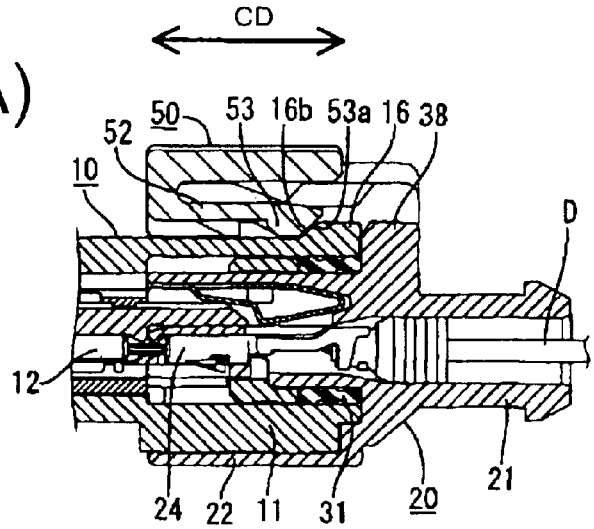
FIGS. 17(A), 17(B) and 17(C) are sections similar to FIGS. 12(A), 12(B) and 12(C) but showing the slider moved back to the initial mount position after the housings are connected properly.
Figure 17B:
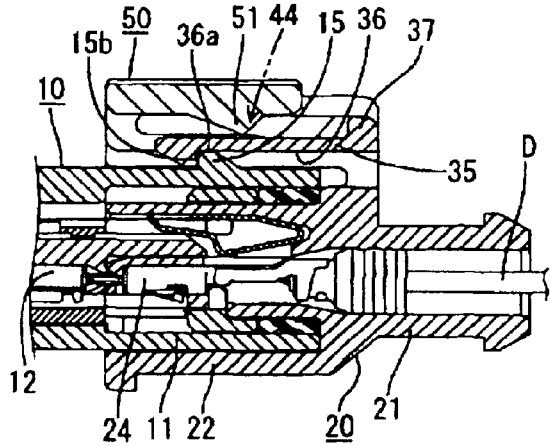
Figure 17C:
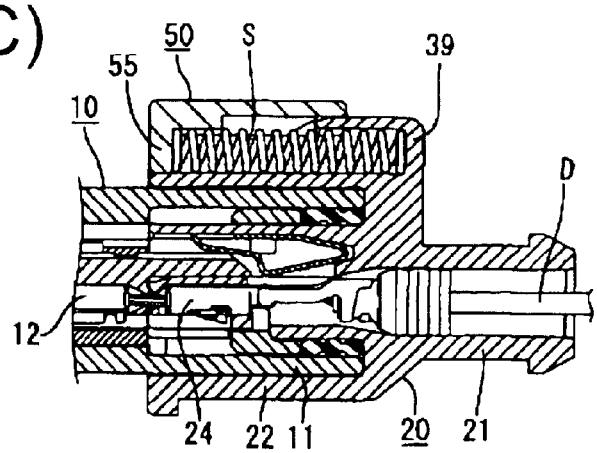
Figure 18A:
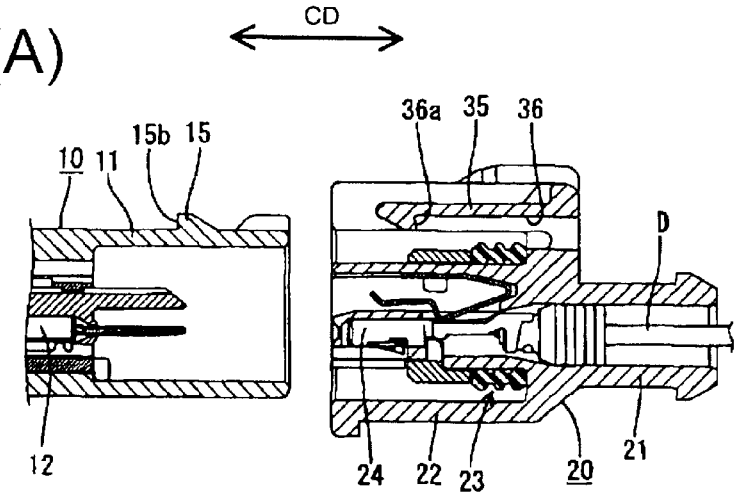
FIGS. 18(A) and 18(B) are sections similar to FIGS. 12(A) and 12(B) but show the slider and coil springs detached in state before the two housings are connected and in a state where the two housings are connected properly
Figure 18B:
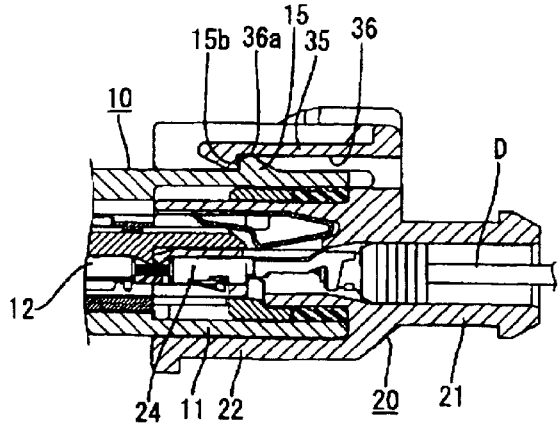

The two housings 10, 20 may have to be separated for maintenance or other reason. In such a case, the slider operating portions 58 of the slider 50 are held and pulled to move the slider 50 back with respect to the housings 10, 20. Thus, the unlock pushing portion 51 is retracted back from the deformation space 44 for the lock arm 35, and the rear surfaces 53*a* of the hooks 53 slide along the rear surfaces 16*b* of the pushing portion 16 to move the hooks 53 onto the pushing portion 16. Thus, the pushable arms 52 are displaced resiliently up. In this process, the compression coil springs S are compressed. The unlock pushable portion 37 is pushed by the unlock pushing portion 51 when the slider 50 is pulled to the retreated position as shown in FIGS. 16. This pushing force displaces the lock arm 35 due to the inclination of the front surface 37*a* of the unlock pushable portion 37 (see FIG. 16(B)). The locked state of the housings 10, 20 is canceled when the lock arm 35 is displaced sufficiently for the front surface 36*a* of the groove 36 to disengage completely from the rear surface 15*b* of the lock 15. Thus, the female housing 20 can be pulled apart from the male housing 10. The lock arm 35 then moves over the lock 15 and resiliently restores. Thus, the compression coil springs S are released and the female housing 20 is moved back with respect to the slider 50 to the initial mount position. In this way, the operation of moving the slider 50 back, the operation of resiliently displacing the lock arm 35 to cancel the locked state and the operation of pulling the housings 10, 20 apart is performed merely by pulling the slider 50 back.

Figure 19A:
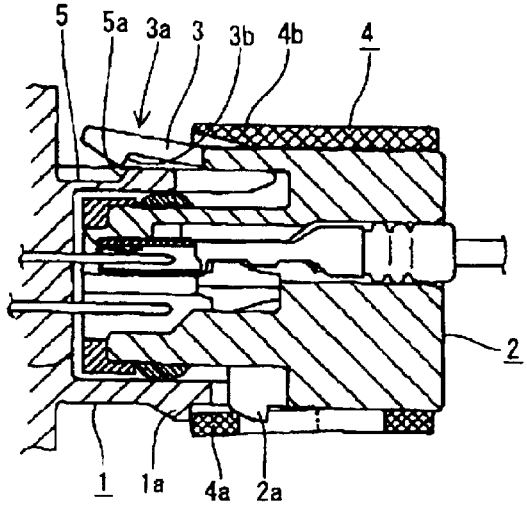
FIG. 19(A) PRIOR ART
FIGS. 19(A) and 19(B) are sections immediately before a prior art connector is connected properly and a state where the prior art connector is connected properly.
Figure 19B:
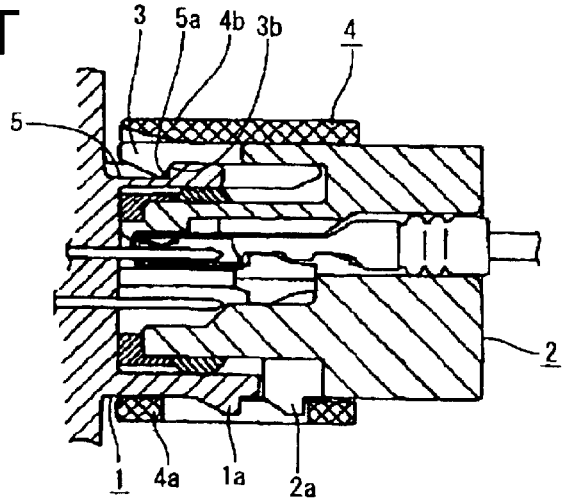
FIG. 19(B) PRIOR ART

The prior art connector of FIGS. 19 has a semi-locking construction to facilitate separation, and the slider 4 prevents displacement of the lock arm 3 to compensate for an insufficient holding force of the semi-locking construction between the prior art housings 1, 2. Thus, a holding force of the housings 1, 2 is insufficient if the prior art housings 1, 2 are connected without the slider 4.

In contrast, the unlock pushing portion 51 of the slider 50 of the subject invention engages the unlock pushable portion 37 on the female housing 20 to displace the lock arm 35 for facilitating separation. Thus, the connector of the subject invention does not need a semi-locking construction. Accordingly, the locked state of the housings 10, 20 is not canceled automatically if a pulling force acts on the connected housings 10, 20. More specifically, the rear surface 15*b* of the lock 15 is substantially vertical and the front surface 36*a* of the groove 36 in the lock arm 35 is undercut. Thus, the housings 10, 20 can be locked with a sufficient holding force even if the slider 50 does not prevent resilient displacement of the lock arm 35. Accordingly, the connector of this embodiment can be used without the slider 50 and the compression coil springs S if a partial connection preventing function is not needed, and costs can be remarkably reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The unlock pushing portion prevents resilient displacement of the lock arm in the foregoing embodiment. However, displacement of the lock arm may be prevented separately from the unlock pushing portion according to the invention. Conversely, an embodiment in which the slider does not prevent displacement of the lock arm also is embraced by the invention.

In the foregoing embodiment, the slider has the unlock pushing portion and the female housing has the unlock pushable portion. However, the unlock pushable portion may be deleted and the unlock pushing portion may be positioned to lift the front of the lock arm as the slider is moved back. Alternatively, the unlock pushing portion may be deleted and the unlock pushable portion may be positioned to be pushed by the rear end of the slider.

In the foregoing embodiment, the unlock pushing portion is fixed. However, the slider may have a flexible operable piece that is resiliently deformable up and down in a direction intersecting the connecting direction CD and the lock arm may be displaced by pressing the flexible operable piece down when the slider reaches the retreated position, i.e. an embodiment where the locked state cannot be canceled merely by moving the slider backward.

The slider may have a frame-shape and may surround the female housing according to the invention.

The slider and the compression coil springs may be assembled into the male housing and the slider may be pushed by the female housing. Although the wire-to-wire connector is illustrated in the foregoing embodiment, the invention is also applicable to a connector in which the male housing is connected directly with a piece of equipment.

Although compression coil springs are the biasing member in the foregoing embodiment, leaf springs, resilient rods or the like may be used.

Although the connector has a watertight function in the foregoing embodiment, the invention also is applicable to nonwatertight connectors.

What is claimed is:

1. A connector, comprising:

a housing (20) connectable with a mating housing (10);

a lock arm (35) on the housing (20) and engageable with a lock (15) on the mating housing (10) when the housings (20, 10) are connected properly;

a slider (50) assembled With the housing (20) and movable forward and back substantially along a connecting direction (CD) of the housings (20, 10);

at least one biasing member (S) between the slider (50) and the housing (20) and resiliently compressable while accumulating a biasing force to separate the housing (20) from the mating housing (10) as the slider (50) is moved backward with respect to the housing (20);

at least one pushable portion (52) displaceable on the slider (50) along a direction intersecting the connecting direction (CD) and being pushable back by at least one pushing portion (16) on the mating housing (10) in the process of connecting the two housings (20, 10); and a push canceling portion (38) on the housing (20) for displacing the pushable portion (52) to cancel a pushed state of the pushable portion (52) by the pushing portion (16) as the two housings (20, 10) are connected properly.

2. The connector of claim 1, wherein an unlocking portion (37) is provided on one of the slider (50) and the lock arm (35) for resiliently displacing the lock arm (35) and disengaging the lock arm (35) from the lock (15) as the slider (50) is moved back with respect to the housing (20).

3. The connector of claim 1, wherein the lock arm (35) is resiliently displaceable while moving onto the lock (15) in the process of connecting the two housings (20, 10).

4. The connector of claim 1, wherein the slider (50) is substantially plate-shaped and is mounted on one side surface of the housing (20).

5. The connector of claim 1, wherein the unlock portion (51) is configured for preventing resilient displacement of the lock arm (35).

6. The connector of claim 1, wherein guiding means (57; 41) are provided on one of the slider (50) and the housing (20) for guiding the movement of the slider (50) with respect to the housing (20).

7. The connector of claim 1, wherein the slider (50) comprises at least one hook (53) for being pushed back by the pushing portion (16) to move the slider (50) back with respect to the housing (20) in the process of connecting the two housings (20, 10).

8. The connector of claim 7, wherein the hook (53) moves onto the push canceling portion (38) and the pushable portion (52) is resiliently displaced up as the two housings (20, 10) are substantially properly connected, thereby canceling the pushed state of the hook (53) by the pushing portion (16).

9. The connector of claim 1, wherein, when the slider (50) is at an initial mount position (FIGS. 9–12) before the housing (20) is connected to the mating housing (10), the biasing member (S) is compressed sufficiently for substantially suppressing a shaking of the slider (50) along the connecting direction (CD).

10. The connector of claim 1, wherein the lock arm (35) is resiliently displaceable into a deformation space (44) and the unlocking portion (51) enter the deformation space (44) to prevent resilient displacement of the lock arm (35) while the slider (50) is moved back by a specified distance from an initial mount position (FIG. 12).

* * * * *